US007063346B2

(12) United States Patent
Elkington

(10) Patent No.: US 7,063,346 B2
(45) Date of Patent: Jun. 20, 2006

(54) SNOWBOARD BINDING

(75) Inventor: Mark Elkington, Tuen Mun (HK)

(73) Assignee: Goodwell International Ltd., Tortola (VG)

( * ) Notice: Subject to any disclaimer, the term of this patent is extended or adjusted under 35 U.S.C. 154(b) by 149 days.

(21) Appl. No.: 10/808,103

(22) Filed: Mar. 24, 2004

(65) Prior Publication Data

US 2004/0207166 A1 Oct. 21, 2004

(30) Foreign Application Priority Data

Mar. 25, 2003 (DE) ..... 103 13 342

(51) Int. Cl.
*A63C 9/02* (2006.01)

(52) U.S. Cl. ..... 280/618; 280/11.3; 280/623; 280/629; 280/14.21; 280/14.22; 280/14.24

(58) Field of Classification Search ..... 280/617, 280/618, 623, 626, 11.3–11.34, 11.36, 624, 280/625, 627–637, 611–616, 809, 811, 600, 280/14.21–8

See application file for complete search history.

(56) References Cited

U.S. PATENT DOCUMENTS

| | | | | |
|---|---|---|---|---|
| 6,007,085 | A | 12/1999 | Rigal et al. | |
| 6,189,899 | B1 | 2/2001 | Carlson | |
| 6,428,032 | B1 * | 8/2002 | Humbel | 280/613 |
| 6,505,841 | B1 | 1/2003 | Kessler et al. | |
| 6,666,472 | B1 * | 12/2003 | Joubert Des Ouches | 280/607 |
| 6,786,502 | B1 * | 9/2004 | Carlson | 280/633 |
| 6,817,622 | B1 * | 11/2004 | Dodge | 280/618 |
| 2003/0116931 | A1 * | 6/2003 | Quattro et al. | 280/14.21 |

FOREIGN PATENT DOCUMENTS

| | | | |
|---|---|---|---|
| DE | 295 01 515.2 | U1 | 2/1995 |
| DE | 296 09 789 | U1 | 6/1996 |
| DE | 10015457 | A1 * | 10/2001 |
| EP | 0 351 298 | A2 | 7/1989 |
| EP | 0 840 640 | B1 | 3/1999 |
| FR | 2 575 660 | A1 | 7/1986 |
| FR | 2 627 097 | A1 | 8/1989 |
| FR | 2755025 | A1 * | 4/1998 |
| WO | WO 89/08480 | A1 | 3/1989 |
| WO | WO 02/070087 | A1 | 9/2002 |

* cited by examiner

*Primary Examiner*—Christopher P. Ellis
*Assistant Examiner*—Vaughn Coolman
(74) *Attorney, Agent, or Firm*—Senniger Powers

(57) ABSTRACT

A snowboard binding having a mounting plate for attachment to a snowboard in spaced-apart relation thereto, a clamping plate arranged between the snowboard and the mounting plate, a peg that projects from the clamping plate and extends through an opening in the mounting plate, a base plate that has an opening over which a hold-down plate extends, and a hold-down plate coupled to the clamping plate by means of a central opening via the peg. The mounting plate opening is substantially larger than the dimension of the peg of the clamping plate in two shift directions (x, y) extending perpendicular to each other, so that the clamping plate and the hold-down plate coupled with it can move, together with the base plate, relative to the mounting plate in the two shift directions. There is a positive-fit connection of the mounting plate to the clamping plate and/or the hold-down plate.

19 Claims, 4 Drawing Sheets

SNOWBOARD BINDING

FIELD OF THE INVENTION

The invention relates to a snowboard binding.

BACKGROUND OF THE INVENTION

European patent EP 0 351 298 A2 discloses a binding having a mounting part, which can be attached by means of screws to the surface of a snowboard. The mounting part has a recess in the form of an elongated hole. A peg projects through this elongated hole and is set at a distance from a clamping plate, which is arranged between the bottom side of the mounting part and the top side of the snowboard and which can move in the direction of the mentioned elongated hole. A base plate can be set on the mounting part, wherein the base plate also has a recess through which said peg projects. The typical attachment elements are attached to the base plate for holding a shoe on the base plate. Above the base plate there is a hold-down plate which has a central recess through which a screw is inserted and can be screwed into threads of the mentioned peg of the clamping plate. When the screw is tightened, the base plate is fixed between the hold-down plate and the mounting plate because the hold-down plate is pulled against the clamping plate. When the screw is loosened, the entire unit consisting of the clamping plate, mounting plate, and hold-down plate can be shifted in the elongated hole of the mounting plate, which allows the position of the binding to be set in a longitudinal direction. Here, the screw has an activation handle so that it can also be tightened and loosened by hand, thus without a tool.

EP 0 840 640 B1 shows a similar binding, for which, however, the mounting plate with elongated hole is incorporated into the body of the snowboard and has a box-like profile with an elongated slot. A similar binding is also shown in DE 295 01 515 U1, for which a guide profile is also incorporated into the body of the snowboard. Instead of a hold-down plate, there is merely a central screw at this position that engages through a corresponding hole of the base plate. One such binding is also shown in FR 25 75 660 A1.

A common feature in all of the mentioned bindings is that the position of the binding can be adjusted easily and without a tool in the longitudinal direction of the snowboard, wherein for this prior art fixing of the binding is always realized by frictional forces. Some of these bindings, e.g., EP 0 840 640 B1 and EP 0 351 298 A2, also allow adjustment of the rotational position of the base plate relative to a rotational axis perpendicular to the snowboard surface.

FR 26 27 097 A1 and WO 98/08480 A1 show snowboard bindings, for which only the rotational position of the base plate can be changed without a tool. For FR 26 27 097 A1, toothed racks, which engage in counter teeth and which can move linearly, are attached to a rotary plate. The racks are shifted with a lever, which can open or close the toothing. For WO 98/08480 A1, the base plate is attached to a rotary plate with a locking peg, which is formed on the rotary plate, can move perpendicular to the snowboard surface, and can be locked in holes of a counter plate.

For the last-mentioned bindings, only the rotational position of the binding can be set, but not its position relative to the surface of the snowboard.

All of these bindings have the essential purpose that every adjustment is simple to realize, so that these bindings are suitable, above all, for snowboard rental, where the binding frequently must be adjusted to different users. Such bindings are also suitable for persons who like to find their optimal position by experiment, and who like to try different binding positions or alignments quickly, without tools, while on the slope.

In general, the adjustment of position and alignment for a snowboard binding should have three degrees of freedom, namely in the longitudinal direction of the snowboard in the cross direction of the snowboard, and relative to a rotational axis perpendicular to the snowboard surface where the adjustment should be realized as much as possible with no steps or very fine steps. Here, it is desirable, as in the mentioned prior art, if the adjustment can be performed simply and without tools. Finally, the set position should be reliably maintained even for large forces such as those occurring between the binding and snowboard while riding the snowboard.

SUMMARY OF THE INVENTION

Therefore, the problem of the invention is to improve the snowboard binding mentioned in the introduction such that it can be adjusted in three degrees of freedom, the adjusted position is maintained reliably, and the adjustment is simple.

Briefly, therefore, the invention is directed to a snowboard binding comprising a mounting plate for attachment to a snowboard surface in spaced-apart relation thereto and having a mounting plate opening, a clamping plate having a peg projecting through the mounting plate opening, a base plate having a base plate opening, and a hold-down plate having a central hold-down plate opening for receiving the peg, wherein the hold-down plate extends over and beyond the base plate opening. There is a clamp fixing the clamping plate and the hold-down plate to the mounting plate. The mounting plate opening is substantially larger than dimensions of the peg in two directions that are perpendicular to each other, so that the clamping plate, the hold-down plate, and the base plate can move relative to the mounting plate in these two directions. There is a positive-fit connection of the mounting plate to the clamping plate and/or of the hold-down plate to the mounting plate.

The basic principle of the invention lies in the mounting part having a recess which is large enough that an adjustment along two axes of a Cartesian coordinate system in the plane of the snowboard surface is enabled, where fixing of the position is realized by a positive-fit toothed section.

According to a refinement of the invention, the direction of motion in the longitudinal direction of the snowboard (x-direction) is decoupled from the transverse direction (y-direction). For this purpose, between the top side of the clamping plate and the bottom side of the mounting plate there is a straight line toothed section, and between the top side of the mounting plate and the bottom side of the hold-down plate there is likewise a positive-fit connection that permits motion in only one direction perpendicular to the direction of motion of the first-mentioned toothed section.

In a different variant of the invention, a toothed section is provided between only the bottom side of the mounting plate and the top side of the clamping plate. Preferably, the teeth have a pyramid shape and the counter teeth have corresponding recesses.

In the plan view, the clamping plate preferably has the shape of a cross with four legs or a star with three legs, whereby for the given size of the mounting plate the adjustment region can be increased because the legs can still reach between attachment pedestals of the mounting plate.

BRIEF DESCRIPTION OF THE FIGURES

In the following, the invention is explained in more detail with reference to embodiments in connection with the drawings. Shown are.

In the individual figures, the same reference symbols correspond to the same or functionally equivalent parts.

DETAILED DESCRIPTION OF PREFERRED EMBODIMENTS

This application claims priority from German application 103 13 342.9, filed Mar. 25, 2003, the entire disclosure of which is expressly incorporated herein by reference.

Figure 1:
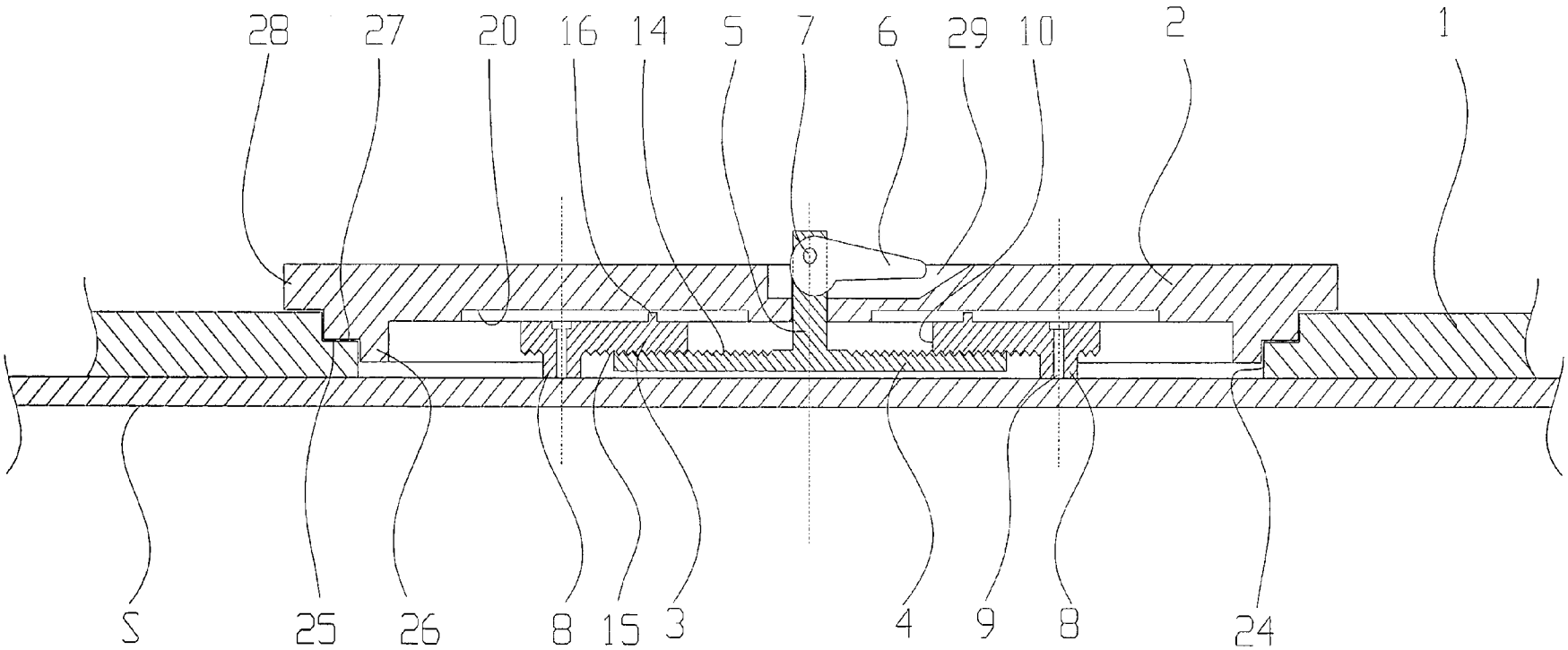
FIG. 1, a cross section of a snowboard binding according to a first embodiment of the invention.

Initially, reference is made to FIG. 1. The binding is fixed to the surface of a snowboard S. This has a base plate 1, to which the typical holding elements for fastening a shoe (not shown) are attached. These elements can be, e.g., instep straps, toe plates, retaining clips for boot soles or other known retaining devices, which are not shown and which are available in a wide range of different embodiments in the prior art and on the market.

The binding according to the invention further has a mounting plate 3, a clamping element 4 with peg 5 extending in the perpendicular direction, and a clamping lever 6 that is attached to a a pin 7 forming a pivot axis so that it can pivot on the peg 5.

The mounting plate 3 is attached to the surface of the snowboard S by several pedestals 8, which each feature a hole 9. This attachment is typically realized by means of screws not shown, which engage in nuts that are incorporated as so-called inserts in the body of the snowboard S. For most snowboards on the market today, these nuts are arranged in the pattern of a square with a side length of 4 cm so that the holes 9 are also arranged in a corresponding way. Obviously, it is also possible to arrange the pedestals and holes according to other patterns of inserts, e.g., in the shape of an equilateral triangle.

The mounting plate 3 can be rectangular (cf. FIG. 2) or also circular (FIGS. 3 and 4) in the plan view. The pedestals 8 hold the mounting plate at a distance from the surface of the snowboard S. The mounting plate 3 has a central opening 10, which is preferably rectangular and whose dimensions determine the adjustment range in the x and y directions (cf. FIG. 2). Between the surface of the snowboard S and the mounting plate 3 there is a clamping element 4, from which a central peg 5 extends in the perpendicular direction upwards in the z-direction and reaches through the opening 10 of the mounting plate 3. This peg 5 further reaches through an opening 11 of the hold-down plate 2, so that this is coupled to the clamping element 4 by the peg 5. The cross section of the peg 5 and the opening 11 are preferably rectangular or square, so that in the rotational direction c the clamping element 4 and the hold-down plate 2 are coupled with a positive fit.

The peg 5 has a transverse hole 12, via which the clamping lever 6 can be attached by means of a pivot axis formed as a pin. This pin 7 is supported on the clamping lever 6 by means of a corresponding hole 12', with the clamping lever having a clamping area 13 that is eccentric relative to the axis of the pin 7 and that bears against the top side of the hold-down plate 2. By pivoting the pivot lever 6 about the axis of the pin 7, the hold-down plate 2 is thus moved against the clamping element 4 in the z-direction, whereby the hold-down plate 2 and the clamping element 4 are pressed from above or below against the corresponding surfaces of the mounting plate 3. The arrangement of the eccentric clamping area 13 relative to the clamping lever 6 is chosen so that when the clamping lever 6 is pressed downwards the mentioned connection is tightened, and when the lever is raised the mentioned connection is loosened.

Figure 2:
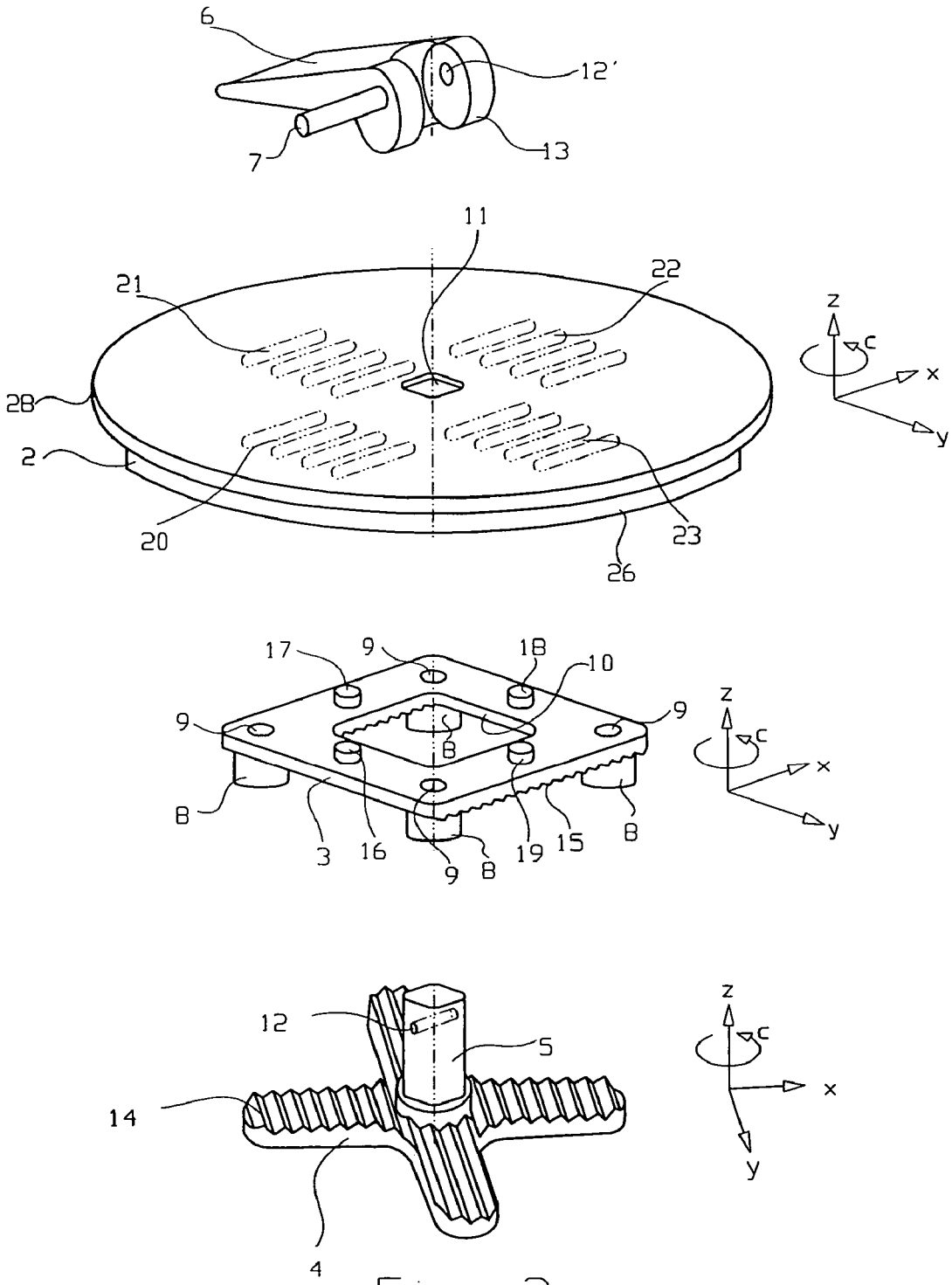
FIG. 2, an exploded drawing of details of the snowboard binding of FIG. 1.

In the embodiment of FIGS. 1–3, there is a toothed section 14, 15 between the top side of the clamping element 4 and the bottom side of the mounting plate 3, with the teeth extending here in the y-direction. In this way, when the toothed sections 14 and 15 are engaged, the clamping element can still be moved in the y-direction relative to the stationary mounting plate 3.

On the top side of the mounting plate 3 there are several projecting pins 16, 17, 18, and 19, which engage in appropriate elongated recesses 20, 21, 22, and 23, respectively, in the bottom side of the hold-down plate 2, these recesses 20–23 being formed like blind hole recesses that do not extend completely through the thickness of the hold-down plate 2. These recesses 20–23 are used as guides for the pins 16–19 and permit shifting of the hold-down plate 2, relative to the mounting plate 3, in the x-direction.

Thus, for both directions of movement x and y, a positive-fit coupling is realized of the hold-down plate 2, in connection with the clamping element 4, to the mounting plate 3, wherein the directions of movement (x and y) are decoupled from each other.

Here, there are several recesses 20–23, so that the pins can be inserted selectively in one of the recesses of a group. This produces further stepped adjustability in the y-direction.

As can be seen best from FIG. 1, the base plate 1 has a circular opening 24, whose edge is formed with a toothed section 25. The hold-down plate 2 has a shoulder 26 that extends perpendicular to the surface of the snowboard S and engages in the opening 24. It further has a counter toothed section 27 which engages in the toothed section 25 of the base plate 1, and also another projecting edge 28 that extends past the top side of the base plate 1 bordering the counter toothed section 27. The length of the shoulder 26 is selected so that the end of the shoulder is still at a distance from the surface of the snowboard S even when the binding is fixed. If the clamping lever 6 is in the released position, then the hold-down plate 2 can be raised easily so that the toothed sections 25 and 27 are free from each other. The base plate 1 then can be rotated about the z-axis in the direction of the arrow c of FIG. 2. Preferably, the toothed section 25, 27 is selected so that the teeth are shorter than those of toothed sections 14, 15 or than the pins 16–19 in connection with recesses 20–23. This means that in a first released position of the pivot lever 6, the hold-down plate 2 can be raised far enough from the base plate 1 that the base plate 1 can rotate about the z-axis, while there is still an engagement between the toothed sections 14, 15 or the positive-fit connection 16–19 with 20–23 and thus there is still no shift in the x or y directions. Thus, the rotational setting of the base plate is also decoupled from the two other possible settings in the x and y directions.

In a similar way, the toothed sections 14, 15 can be formed so that the height of the teeth is smaller than the height of the pins 16–19, so that in another released position of the pivot lever 6, adjustment perpendicular to the longitudinal direction of the teeth 14, 15, i.e., in the x-direction, is possible, but the pins 16–19 remain in engagement with the recesses 20–23.

From FIG. 1 it can also be seen that the hold-down plate 2 has a recess 29 in the region of the clamping lever 6, so that the clamping lever 6 can be at least partially countersunk. This recess 29 is omitted from the other figures to simplify the concepts depicted therein.

Figures 3A, 3B, 3C, 3D, 3E, 3F, 3G, 3H, 3I:
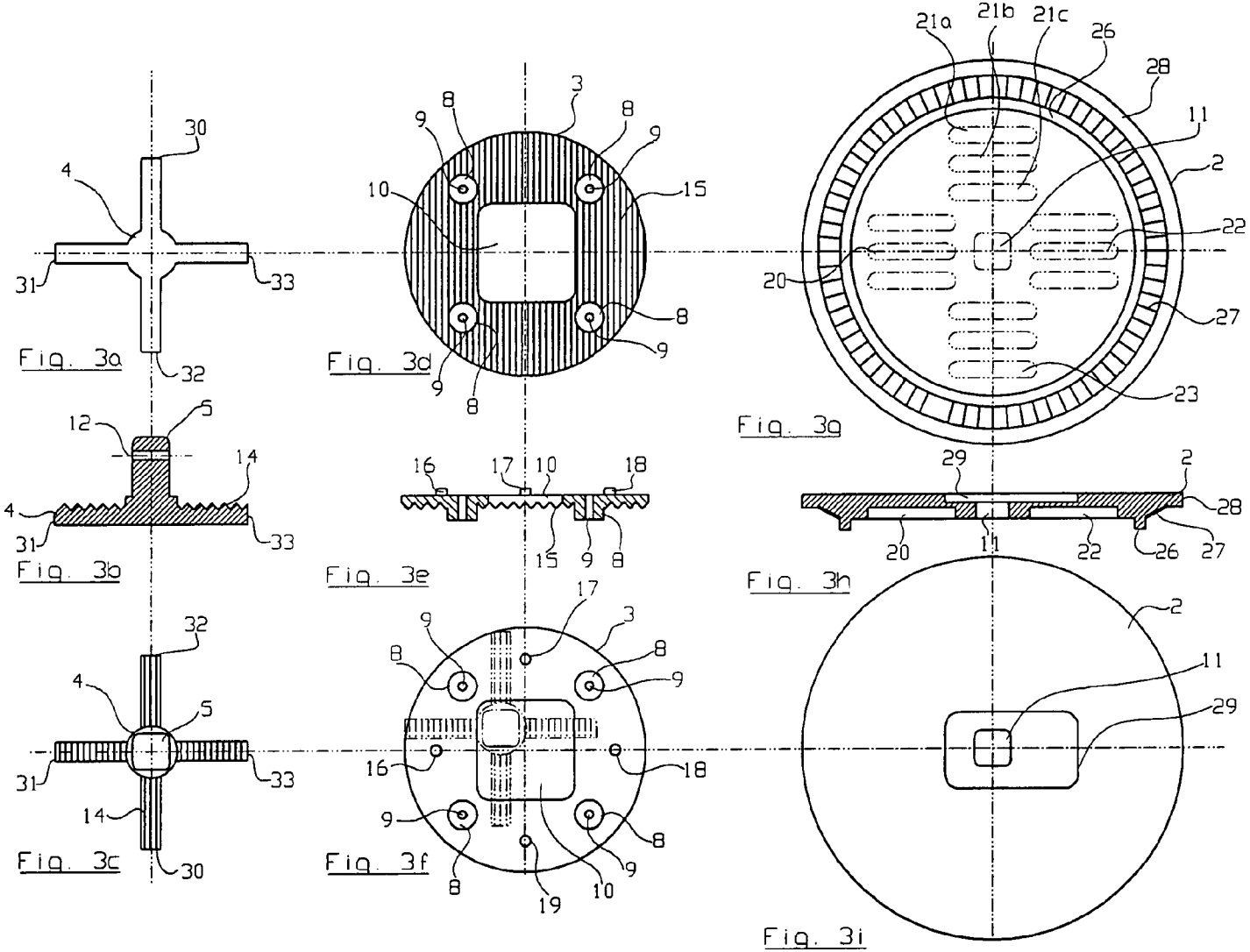
FIG. 3, plan views, cross sections, and bottom views of details of the snowboard binding of FIG. 1, namely FIGS. 3*a*, 3*b*, and 3*c*, a bottom view, a cross section, and a plan view of the clamping element, FIGS. 3*d*, 3*e*, and 3*f*, a view from below, a cross section, and a plan view of the mounting plate, FIGS. 3*g*, 3*h*, and 3*i*, a view from below, a cross section, and a plan view of the hold-down plate.

In FIG. 3, the clamping element 4 (FIGS. 3*a*–3*c*), the mounting plate 3 (FIGS. 3*d*–3*f*), and the hold-down plate 2 (FIGS. 3*g*–3*i*) are each shown in three views, namely from the bottom side, in cross section, and from the top side. From FIGS. 3*a* and 3*c*, it can be seen that the clamping element 4 in the illustrated embodiment has four arms 30, 31, 32, and 33, which stand at right angles to each other and which carry the toothed section 14 on their top side. The length of the arms 30–33 is tailored to the size of the opening 10 of the mounting plate 3, so that in all possible limiting positions for which the peg 5 contacts the wall of the opening 10, all four arms 30–33 still project beyond the opening 10 of the mounting plate so that the arms are always covered by the mounting plate and thus are held.

As can be seen best from FIG. 3*c*, the toothed section 14 extends over the arms 30–33 in a uniform direction. In the illustrated embodiment, the toothed section 14 thus runs parallel to the longitudinal direction of the arms 30 and 32 and perpendicular to the longitudinal direction of the arms 31 and 33.

In FIG. 3*f*, the clamping element 4 is shown with dashed lines in a limiting position. From here it can be seen that the arms reach between the adjacent pedestals 8, so that one obtains as large a displacement path as possible for the clamping element 4.

For the configuration shown in FIG. 3 with four pedestals 8, the clamping element 4 has four arms. For another configuration of pedestals, the number of arms can be adapted accordingly. For example, if there are three pedestals at the vertices of an equilateral triangle, then the clamping element 4 has only three arms which then extend at an angle of 120° to each other. Obviously, for such a configuration the toothed section 14 is also to be distributed in a uniform direction over the arms.

From FIG. 3*f* it can further be seen that the pins 16–19 extending from the top side of the mounting plate 3 are offset relative to the pedestals 8 by 45°, in the plan view of FIG. 3*f*. It can further be seen from FIGS. 3*d* and 3*f* that the mounting plate 3 can also be circular in the plan view, in contrast to the embodiment of FIG. 2, where the mounting plate 3 is square. If it is desirable to make the displacement path in one direction (x or y) greater than in the other direction, then the mounting plate 3 and the opening 10 can also be rectangular, wherein then the side length is greater in one direction than in the other.

As can be seen best from FIG. 3*g*, the hold-down plate 2 has on its bottom side a total of four groups each with three elongated recesses, which are parallel to each other. This is made clear for the recesses 21 by the three reference symbols 21*a*, 21*b*, and 21*c*.

In the illustrated embodiment, the pin 17 engages in one of these three recesses, wherein the remaining pins 16, 18, and 19 engage in the corresponding recesses 20, 22, and 23. Obviously, the outer diameter of the mounting plate 3 is smaller than the inner diameter of the projecting shoulder 26 of the hold-down plate 2, so that the mounting plate 3 always lies within this shoulder 26 in all possible positions.

At this point, it should also be mentioned that there is a positive-fit connection between the top side of the mounting plate 3 and the bottom side of the hold-down plate 2, with the configuration with pins 16–19 and associated recesses 20–23 being only one possible embodiment. Here it would also be possible, e.g., to provide a toothed section analogous to the toothed section 14, 15.

Figure 4:
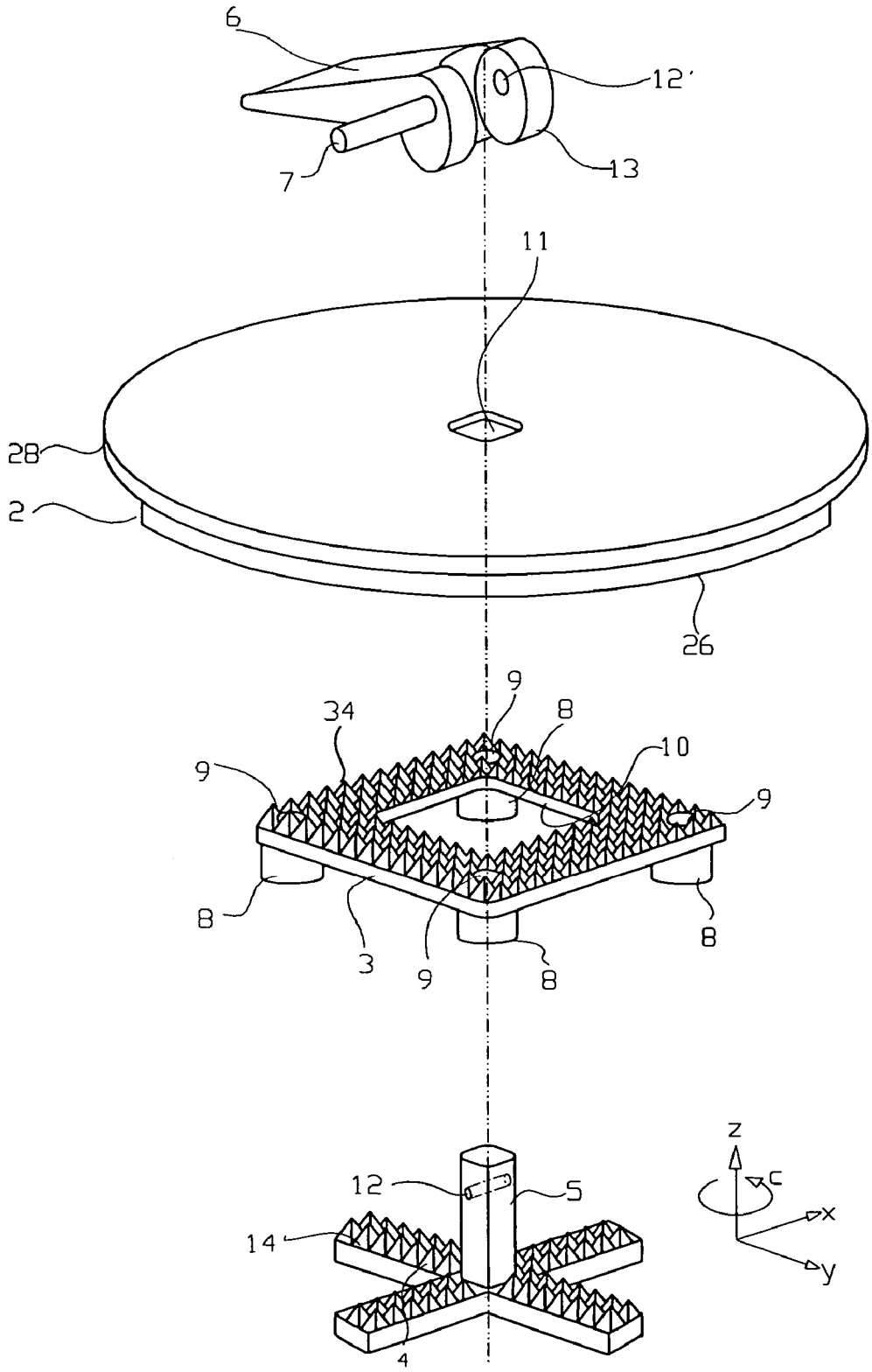
FIG. 4, an exploded drawing similar to FIG. 2 of a second embodiment of the invention.

FIG. 4 shows an exploded view of the essential parts of the snowboard binding similar to FIG. 2, however also without the base plate. The embodiment of FIG. 4 differs from that of FIG. 2 by the type of toothed section. Here there is toothed section 14' with regular pyramid-shaped teeth on the top side of the clamping plate 4. The teeth are arranged in the x and y direction at regular intervals. Corresponding recesses are provided in the bottom side of the mounting plate 3 into which the teeth of toothed section 14' engage.

In a corresponding way, toothed section 34 with pyramid-shaped teeth is formed on the top side of the mounting plate 3. These teeth are likewise aligned and spaced regularly in the x and y directions. Then the bottom side of the hold down plate 2 likewise has pyramid-shaped recesses corresponding to the teeth 34.

It is clear that one of the two toothed sections 14 or 34 could be left out, because the hold down plate 2 and the clamping plate 4 are coupled rigidly in the x and y directions by means of the peg 5 and the opening 11. Thus, in a preferred embodiment, the toothed section 14' on the clamping plate 4 is left out, so that its arms have a smooth, flat surface and the bottom side of the mounting plate 3 is likewise smooth and flat. Otherwise, the embodiment of FIG. 4 corresponds to that of FIG. 2.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above methods and products without departing from the scope of the invention, it is intended that all matter contained in the above description and shown in the accompanying drawings shall be interpreted as illustrative and not in a limiting sense.

What is claimed is:

1. A snowboard binding comprising:

a mounting plate for attachment to a snowboard surface in spaced-apart relation thereto and having a mounting plate opening;

a clamping plate having a peg projecting through the mounting plate opening;

a base plate having a base plate opening;

a hold-down plate having a central hold-down plate opening for receiving the peg, wherein the hold-down plate extends over and beyond the base plate opening;

a clamp fixing the clamping plate and the hold-down plate to the mounting plate;

wherein the mounting plate opening is substantially larger than dimensions of the peg in two shift directions that are perpendicular to each other, so that the clamping plate, the hold-down plate, and the base plate can shift relative to the mounting plate in these two directions;

wherein there is a positive-fit connection of the mounting plate to the clamping plate and/or of the hold-down plate to the mounting plate; and wherein the mounting plate is spaced apart from the surface of the snowboard by pedestals and the clamping plate has arms that can be pushed between adjacent pedestals, wherein the sum of the dimension of the peg in each shift direction and the length of each arm in each shift direction is greater than the width of the mounting plate opening in each shift direction.

2. The snowboard binding according to claim 1 wherein the mounting plate opening and the peg are dimensioned so that the shift in said two directions that are perpendicular to each other is at least 4 cm.

3. The snowboard binding according to claim 1 wherein the positive-fit connection is configured such that the shift in one direction is decoupled from the shift in the other direction.

4. The snowboard binding according to claim 2 wherein the positive-fit connection is configured such that the shift in one direction is decoupled from the shift in the other direction.

5. The snowboard binding according to claim 3 wherein the positive-fit connection comprises a toothed section extending in one direction.

6. The snowboard binding according to claim 4 wherein the positive-fit connection comprises a toothed section extending in one direction.

7. The snowboard binding according to claim 3 wherein the positive-fit connection comprises pins and elongated recesses where the elongated recesses extend in one direction.

8. The snowboard binding according to claim 5 wherein the positive-fit connection comprises pins and elongated recesses where the elongated recesses extend in one direction.

9. The snowboard binding according to claim 5 wherein the positive-fit connection further comprises elongated recesses and the longitudinal direction of the toothed sections and the longitudinal direction of the elongated recesses are at right angles to each other.

10. The snowboard binding according to claim 6 wherein the positive-fit connection further comprises elongated recesses and the longitudinal direction of the toothed sections and the longitudinal direction of the elongated recesses are at right angles to each other.

11. The snowboard binding according to claim 7 wherein each of the pins is associated with a group of elongated recesses, wherein each pin can be inserted into one recess of the group.

12. The snowboard binding according to claim 8 wherein each of the pins is associated with a group of elongated recesses, wherein each pin can be inserted into one recess of the group.

13. The snowboard binding according to claim 2 wherein the mounting plate is spaced apart from the surface of the snowboard by pedestals and the clamping plate has arms that can be pushed between adjacent pedestals, wherein the sum of the dimension of the peg in each shift direction and the length of each arm in each shift direction is greater than the width of the mounting plate opening in each shift direction.

14. The snowboard binding according to claim 3 wherein the mounting plate is spaced apart from the surface of the snowboard by pedestals and the clamping plate has arms that can be pushed between adjacent pedestals, wherein the sum of the dimension of the peg in each shift direction and the length of each arm in each shift direction is greater than the width of the mounting plate opening in each shift direction.

15. The snowboard binding according to claim 5 wherein the mounting plate is spaced apart from the surface of the snowboard by pedestals and the clamping plate has arms that can be pushed between adjacent pedestals, wherein the sum of the dimension of the peg in each shift direction and the length of each arm in each shift direction is greater than the width of the mounting plate opening in each shift direction.

16. The snowboard binding according to claim 7 wherein the mounting plate is spaced apart from the surface of the snowboard by pedestals and the clamping plate has arms that can be pushed between adjacent pedestals, wherein the sum of the dimension of the peg in each shift direction and the length of each arm in each shift direction is greater than the width of the mounting plate opening in each shift direction.

17. The snowboard binding according to claim 1 wherein the number of arms corresponds to the number of pedestals.

18. The snowboard binding according to claim 1 wherein between the mounting plate and the clamping plate or the hold-down plate there is a toothed section with pyramid-shaped teeth and corresponding recesses, wherein the teeth are arranged regularly in two shift directions.

19. The snowboard binding according to claim 1 wherein between the mounting plate and the clamping plate or the hold-down plate there is a toothed section with pyramid-shaped teeth and corresponding recesses, wherein the teeth are arranged regularly in two shift directions.

* * * * *